United States Patent [19]

Van Meurs

[11] Patent Number: 4,712,045

[45] Date of Patent: Dec. 8, 1987

[54] ELECTRIC ARRANGEMENT FOR REGULATING THE LUMINOUS INTENSITY OF AT LEAST ONE DISCHARGE LAMP

[75] Inventor: Johannes M. Van Meurs, Eindhoven, Netherlands

[73] Assignee: U.S. Philips Corporation, New York, N.Y.

[21] Appl. No.: 821,107

[22] Filed: Jan. 21, 1986

[30] Foreign Application Priority Data

Jan. 22, 1985 [NL] Netherlands ..... 8500155

[51] Int. Cl.[4] ..... H05B 37/02

[52] U.S. Cl. ..... 315/224; 315/226; 315/278; 315/282; 315/DIG. 4; 315/DIG. 7

[58] Field of Search ..... 315/224, DIG. 7, 226, 315/278, 282, 284, DIG. 4

[56] References Cited

U.S. PATENT DOCUMENTS 4,017,785 4/1977 Perper ..... 315/224
4,370,600 1/1983 Zansky ..... 315/106
4,376,969 3/1983 Bedard ..... 315/DIG. 7
4,525,648 6/1985 DeBijl et al. ..... 315/DIG. 7

*Primary Examiner*—Harold Dixon
*Attorney, Agent, or Firm*—Robert T. Mayer; Bernard Franzblau

[57] ABSTRACT

An electric arrangement for regulating the luminous intensity of at least one discharge lamp (15). The arrangement comprises an electric circuit having a first winding (110) arranged to surround a core (111) of magnetizable material. The winding (110) is included in a circuit forming part of a DC/AC converter for the supply of high-frequency energy to the discharge lamp. The core (111) is further provided with a second winding (112) and a third winding (118). The third winding is connected to a control device forming part of the converter. The third winding is magnetically coupled to the first winding. A series-combination of a non-capacitive variable impedance (115) and a diode (113) is connected between the ends of the second winding.

9 Claims, 1 Drawing Figure

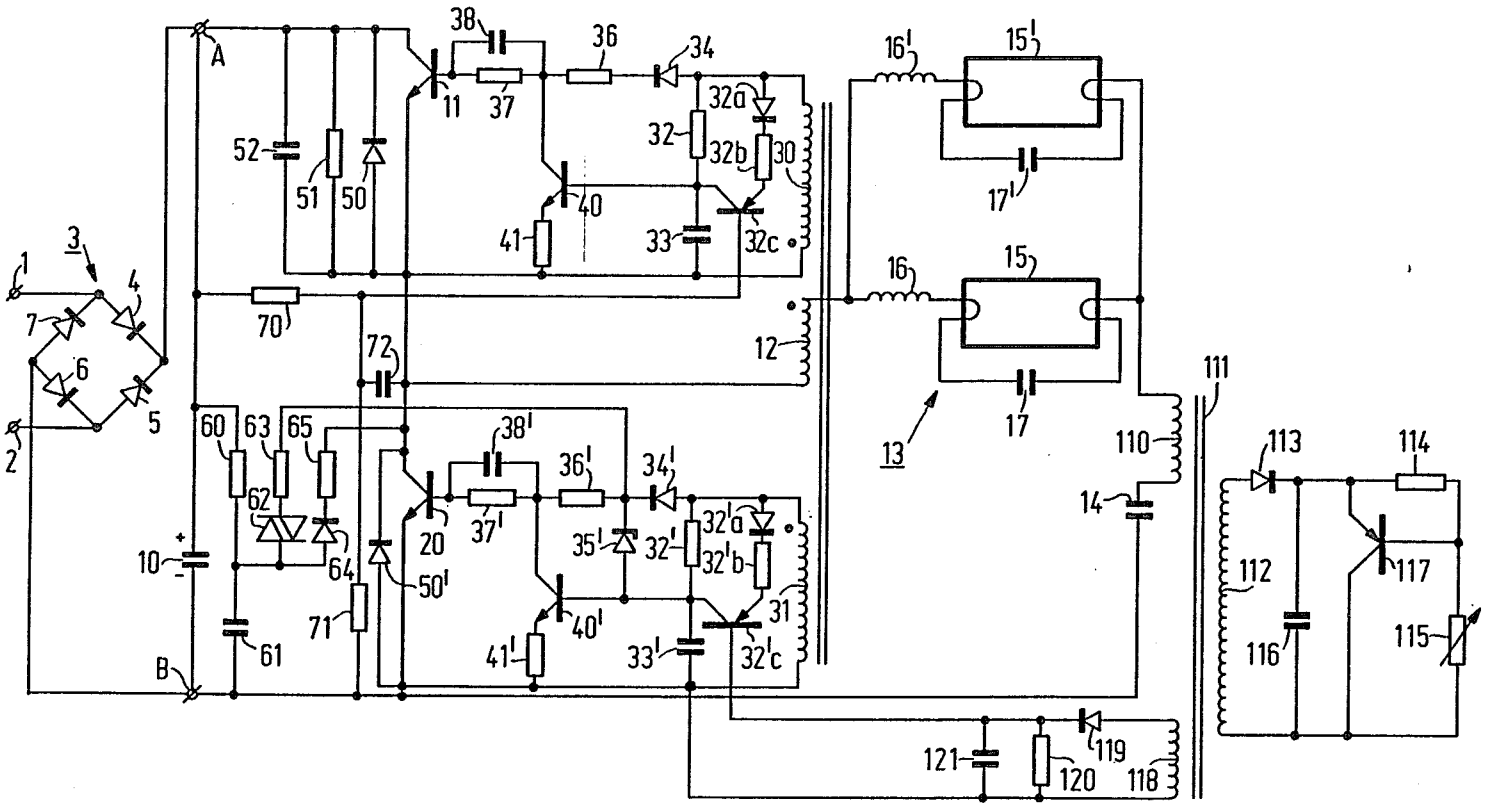
1
2
3
4
5
6
7
10
11
12
13
14
15
15'
16
16'
17
17'
20
30
31
32
32a
32b
32c
32'
32'a
32'b
32'c
33
33'
34
34'
35'
36
36'
37
37'
38
38'
40
40'
41
41'
50
50'
51
52
60
61
62
63
64
65
70
71
72
A
B
110
111
112
113
114
115
116
117
118
119
120
121

ELECTRIC ARRANGEMENT FOR REGULATING THE LUMINOUS INTENSITY OF AT LEAST ONE DISCHARGE LAMP

BACKGROUND OF THE INVENTION

This invention relates to an electric arrangement for regulating the luminous intensity of at least one discharge lamp, the arrangement comprising an electric circuit having a first winding arranged to surround a core of magnetizable material. This winding is included in a circuit for feeding the lamp and the core further includes a second winding coupled magnetically to the first winding.

Such an arrangement is known from U.S. Pat. No. 4,180,764. This Patent discloses an arrangement having an electric circuit comprising a series arrangement of a transductor and a discharge lamp, this circuit being connected to an alternating voltage source. The ends of the second winding of the transductor (the control winding) are connected to a rectifying bridge which has one input connected through a variable impedance to the voltage source. By means of the variable impedance, the inductance of the transductor is influenced and the luminous intensity of the discharge lamp can be regulated.

A disadvantage of this arrangement is that the variable impedance is connected directly to the voltage source (such as an alternating voltage source with a voltage of 220 V), as a result of which comparatively high power losses occur in the arrangement. Moreover, the voltage present at the actuation device of the variable impedance may mean that risks are involved with manual contact thereof. Besides, the arrangement of the circuit is such that it is not suitable to regulate simultaneously the luminous intensity of a plurality of lamps. The circuit comprises such electrical components that it occupies a comparatively large space, which is also disadvantageous.

SUMMARY OF THE INVENTION

The invention has for an object to provide an electric arrangement for regulating the luminous intensity of at least one discharge lamp, in which the aforementioned disadvantages are avoided.

According to the invention, this object is achieved in an arrangement of the kind mentioned in the opening paragraph in that the first winding is included in a circuit which forms part of a DC/AC converter for the high-frequency supply of a discharge lamp, in which the core of magnetizable material has a third winding which is magnetically coupled to the second winding and is connected to a control device forming part of the DC/AC converter, the third winding being magnetically coupled to the first winding, and a series-combination of a non-capacitive variable impedance and a diode being connected between the ends of the second winding.

By means of the said variable impedance, the direct voltage between the ends of the second winding can be varied. The said impedance is, for example, a resistor. This term is further to be understood to mean a circuit by which a variable direct voltage can be obtained (such as a circuit behaving like a variable Zener diode). The impedance is not coupled directly, but only by means of a transformer, to the source of supply. The use of a separate supply source for producing a direct voltage is avoided. The required energy is supplied via the first winding. Due to the fact that the second winding is coupled only magnetically and not electrically to the first winding, better protection against the risks involved with manual contact is provided than in the known arrangement. During operation, only a small current flows through the second and third windings. The components connected to the ends of these windings consequently are of small size. The arrangement is therefore not very voluminous.

The arrangement according to the invention makes it possible to simultaneously dim in a simple manner a group of discharge lamps by means of only one variable non-capacitive impedance. The said windings with the DC/AC converters connected thereto of the second, third, fourth etc. lamps are then connected in parallel across this impedance.

In a particular embodiment of the arrangement according to the invention, a capacitor is connected parallel to the variable impedance in the series arrangement between the ends of the second winding.

This affords the advantage that the electric circuit is less sensitive to disturbing current pulses from the supply mains. The voltage across the capacitor is stabilized on a given value, as a result of which the direct voltage between the ends of the third winding is also less sensitive to disturbances.

BRIEF DESCRIPTION OF THE DRAWING

Embodiments of the invention will now be described more fully with reference to the accompanying drawing. This drawing shows an arrangement according to the invention which is included in an electric circuit of a DC/AC converter of the kind described in U.S. patent application Ser. No. 756,412 (filed July 18, 1985). The drawing further shows a supply source for the said converter and two low-pressure mercury vapour discharge lamps connected to the converter.

DESCRIPTION OF THE PREFERRED EMBODIMENTS

The supply source has two input terminals 1 and 2 intended to be connected to an alternating voltage source. A rectifying bridge 3 comprising four diodes (4 to 7) is connected to the terminals 1 and 2. For example, a filter may be included between the terminals 1 and 2 on the one hand and the bridge 3 on the other hand. An output terminal of the bridge 3 is connected to a first input terminal (A) of the converter. A second output terminal of the bridge 3 is connected to an input terminal (B) of the converter.

In the converter, the terminals A and B are interconnected by a capacitor 10 and further by a series-combination of a first transistor 11, a primary winding 12, load circuit 13 and a capacitor 14. Furthermore, the circuit includes a first winding 110 arranged to surround a core of ferromagnetic material 111. The details of the load circuit and the circuit connected to the first winding are described below.

The load circuit 13 comprises two substantially equal parallel branches. Each of these branches comprises a low-pressure mercury vapour discharge lamp 15 and 15', respectively, in the form of a lamp of about 50 W each in series with a reactive circuit element 16 and 16', respectively, in the form of a coil. Each of the lamps has two preheatable electrodes. The ends remote from the supply source of the electrodes associated with one lamp are interconnected by a capacitor 17 and 17', respectively.

The series-combination of the primary winding 12 of the transformer, the load circuit 13 and the capacitor 14 is shunted by a second transistor 20. Each of the two transistors 11 and 20 is of the npn-type. In the circuit the collector of the transistor 11 is connected to a positive input terminal A of the converter. The emitter of the transistor 11 is connected to the collector of the transistor 20. The emitter of the transistor 20 is connected to the negative input terminal B of the converter.

The current transformer with the primary 12 has two secondary windings 30 and 31. The secondary winding 30 forms part of a control device of the transistor 11. The secondary winding 31 forms part of a control device of the transistor 20. The ends of the secondary winding 30 are interconnected by a first timing circuit comprising a series-combination of a resistor 32 and a capacitor 33. The resistor 32 of this timing circuit is shunted by a series-combination of a diode 32*a*, a resistor 32*b* and the main electrode circuit of a pnp auxiliary transistor 32*c*. The resistor 32' of the second timing circuit is shunted by the series-combination of a diode 32'*a*, a resistor 32'*b* and the main electrode circuit of a pnp auxiliary transistor 32'*c*. The base of this auxiliary transistor is connected to the diode 119. The capacitor 33' connects one end of the winding 118 to the resistor 32'. Further there is provided a series-combination of a diode 34' and a Zener diode 35' shunting the resistor 32'. A diode 34 connected to the resistor 32 is connected through a series-combination of two resistors 36,37 to the base of the transistor 11. The resistor 37 is shunted by a capacitor 38. A transistor 40 of the npn type is connected between a junction between the resistor 36 and the resistor 37 on the one hand and a resistor 41 on the other hand. The resistor 41 is connected to the emitter of the transistor 11. A junction between the resistor 32 and the capacitor 33 is connected to the base of the auxiliary transistor 40. Corresponding circuit elements in the control device of the transistor 20 are again provided with an accent.

A diode 50 is connected antiparallel to the transistor 11. A diode 50' is connected antiparallel to the transistor 20. The transistor 11 is further shunted by both a resistor 51 and a capacitor 52.

There is further provided a circuit for starting the converter. This circuit comprises inter alia a series-combination of a resistor 60 and a capacitor 61 shunting the capacitor 10. A junction between the resistor 60 and the capacitor 61 is connected to a diac 62. The other side of this diac 62 is connected through a resistor 63 to a junction between the resistor 36' and the diode 34' of the control device of the transistor 20. The junction between the resistor 60 and the capacitor 61 is further connected to a diode 64. The other side of this diode 64 is connected through a resistor 65 to the collector of the transistor 20.

The input terminals A and B of the DC/AC converter are interconnected by a voltage divider comprising two resistors 70 and 71. A tapping point between these resistors is connected both to the base of the auxiliary transistor 32*c* and to an auxiliary capacitor 72. The other side of this auxiliary capacitor 72 is connected to a junction between the first transistor 11 and the second transistor 20.

It follows from the Figure that the junction between the two transistors (11,20) is connected through the winding 30 and the circuit elements 32*a* and 32*b* to the emitter of the auxiliary transistor 32*c*.

The arrangement for regulating the luminous intensity of the two lamps (dimming) comprises a first winding 110 arranged to surround the undivided core 111 of ferromagnetic material. The core further comprises a second winding 112 magnetically coupled to the winding 110. A series-combination of a diode 113, a resistor 114 and a variable resistor 115 is connected between the ends of the winding 112. The capacitor 116 is connected in parallel across the elements 114 and 115. A transistor 117 of the pnp type is connected between the junction between the diode 113 and the resistor 114 on the one hand and the end of the winding 112 on the other hand. The base of the transistor 117 is connected to a junction between the resistor 114 and the variable resistor 115.

The ferromagnetic core 111 is further provided with a third winding 118, which is magnetically coupled to the second winding 112 and the first winding 110. This third winding 118 is connected via the diode 119 to the base of the transistor 32'*c* of the control device of the transistor 20 of the converter. The other end of the winding 118 is connected to capacitor 33' of the converter. The resistor 120 and the capacitor 121 are connected in parallel across the winding 118 and the diode 119.

The operation of the circuit of the converter is described in the aforementioned U.S. patent application Ser. No. 756,412, whose disclosure in this respect is incorporated herein by reference. The arrangement for regulating the power consumption of the lamps, by which the luminous intensity of these lamps can be adjusted, operates as follows: The current through the first winding 110 induces a voltage across the second winding 112. During operation, the pulse duration of the current in the winding 112 depends upon the capacitance of the capacitor 116. By variation of the DC voltage across the resistor 115, the voltage across the capacitor 116 is adjusted, as a result of which the voltage across the second winding 112 and the peak value of the voltage across the winding 118 are determined.

By variation of the voltage across the capacitor 121 the speed at which the capacitor 33' is charged is influenced. Furthermore, the instant at which the auxiliary transistor 40' becomes conducting by means of the timing circuit 32' to 35' is influenced. Thus, the instant at which the transistor 20 is switched off will be influenced. By means of the voltage divider 70, 71 and the auxiliary capacitor 72, it is achieved that the control of the transistor 11 follows that of the transistor 20. The power consumption of the lamps 15 and 15' is then changed (the lamps are dimmed).

In an alternative embodiment, the winding 110 is not included in the aforementioned circuit 11, 13 and 14 between the terminals A and B, but between the terminal A and the capacitor 52. In other embodiments, the said winding is included between the diode 50 and the collector of the transistor 11 (or between the diode 50' and the collector of the transistor 20). It is also possible for the winding 110 in series with the capacitor 17 (and 17', respectively) to be connected in parallel with the discharge lamp. In fact, a high-frequency current flows in all of the said areas in the circuit. The ends of the winding 118 are continuously connected in this embodiment to the control device of the transistor 20.

In a particular embodiment, the resistor 115 is replaced by a circuit for regulating the DC voltage (not shown in the drawing). This circuit comprises an npn transistor whose collector is connected to the base of the transistor 117 and whose emitter is connected to the lower end of the winding 112. The collector and the emitter of this npn transistor are shunted by a series-combination of a potentiometer (for example 470 kΩ) and a resistor (for example 15 kΩ). The potentiometer is further connected to the base of the said transistor. The base is connected through a capacitor (for example of 22 nF) also to the end of the winding 112 and further via a resistor (for example of 10 kΩ) to the junction between the resistor of 15 kΩ and the potentiometer.

In a practical embodiment of the arrangement according to the invention, the values of the circuit elements are indicated in the following table.

TABLE

| | |
|---|---|
| Capacitor 10 about | 68 μFarad |
| Capacitor 14 about | 0,5 μFarad |
| Capacitor 17 and 17' each about | 12 nanoFarad |
| Capacitor 33 and 33' each about | 47 nanoFarad |
| Capacitor 38 and 38' each about | 10 μFarad |
| Capacitor 52 about | 3,3 nanoFarad |
| Capacitor 61 about | 100 nanoFarad |
| Capacitor 72 about | 15 nanoFarad |
| Capacitor 116 about | 100 nanoFarad |
| Capacitor 121 about | 100 nanoFarad |
| Coil 16 and 16' each about | 2 mHenry |
| Transmission ratio of the current transformer (12; 30, 31) about | 1 to 5 to 5 |
| Resistor 32, 32' about | 1,2 kOhm |
| Resistor 32b, 32'b about | 390 Ohm |
| Resistor 36 and 36' each about | 22 Ohm |
| Resistor 41 and 41' each about | 100 Ohm |
| Resistor 41 and 41' each about | 0,47 Ohm |
| Resistor 51 about | 1 MOhm |
| Resistor 60 about | 680 Ohm |
| Resistor 63 about | 100 Ohm |
| Resistor 65 about | 10 kOhm |
| Resistor 70 about | 487 kOhm |
| Resistor 71 about | 562 kOhm |
| Resistor 114 about | 15 kOhm |
| Resistor 120 about | 100 kOhm |
| Resistor 115 max. value | 470 kOhm |
| Number of turns winding 110 | 5 |
| Number of turns winding 112 | 50 |
| Number of turns winding 118 | 50 |

What is claimed is:

1. An electric arrangement for regulating the luminous intensity of at least one discharge lamp comprising: a DC/AC converter circuit for the supply of high frequency energy to the discharge lamp, said DC/AC converter circuit having an input coupled to a source of supply voltage, at least one switching transistor and a first winding arranged to surround a core of magnetizable material, said winding being included in an electric circuit for the supply of the discharge lamp and said core further having a second winding coupled magnetically to the first winding, the core of magnetizable material having a third winding which is magnetically coupled to the second winding and is connected to a control device which controls the switching of the switching transistor of the DC/AC converter, the third winding being magnetically coupled to the first winding, and a series-combination of a non-capacitive variable impedance and a diode connected between the ends of the second winding in a manner such that a manual adjustment of the variable impedance determines the voltage developed across the third winding.

2. An electric arrangement for regulating the luminous intensity of at least one discharge lamp comprising: a DC/AC converter circuit having a control device for controlling the supply of high frequency energy from the DC/AC converter circuit to the discharge lamp, a first winding included in a circuit forming a part of the DC/AC converter and arranged to surround a core of magnetizable material with said winding included in an electric circuit for the supply of said energy to the discharge lamp, said core of magnetizable material having second and third windings coupled magnetically to the first winding, said third winding being magnetically coupled to the second winding and being connected to the control device of the DC/AC converter, a series-combination of a non-capacitive variable impedance and a diode connected between the ends of the second winding, and a capacitor connected parallel to the variable impedance in the series-combination between the ends of the second winding.

3. Apparatus for the supply of high frequency current to at least one electric discharge lamp and for adjusting the luminous intensity of the discharge lamp comprising: a DC/AC converter circuit for supplying said high frequency current to a discharge lamp and including at least one switching transistor coupled to a first winding of a first transformer and having a control circuit coupled to a second winding of the first transformer and to a control electrode of the switching transistor to control switching of the transistor, a second transformer having a core of magnetizable material and first, second and third windings on the core such that the second and third windings are magnetically coupled to the first winding, wherein said first winding of the second transformer is included in a circuit which forms a part of the DC/AC converter, a non-capacitive variable impedance element and a diode connected in series across the second winding of the second transformer, and wherein the third winding of the second transformer is magnetically coupled to the second winding of the second transformer and is electrically coupled to said control circuit so as to influence the switching of the transistor in dependence on the setting of said variable impedance element.

4. Apparatus as claimed in claim 3 further comprising a capacitor connected in parallel with the variable impedance element.

5. Apparatus for adjusting the luminous intensity of at least one electric discharge lamp comprising: a pair of input terminals for connection to a source of low frequency AC supply voltage, a high frequency DC/AC converter having an input coupled to the input terminals and output means for coupling a high frequency current to a discharge lamp, said DC/AC converter including a switching transistor and a control circuit coupled to a control electrode of the switching transistor to control the switching of said transistor, a transformer having a magnetic core and first, second and third windings wound thereon with the second and third windings magnetically coupled to the first winding, means connecting the first winding in a circuit that is a part of the DC/AC converter, a non-capacitive variable impedance element and a diode connected in series across the second winding of the transformer, and means coupling the third winding to said control circuit, wherein the third winding is magnetically coupled to the second winding such that adjustment of the variable impedance element controls the voltage developed across the third winding and thereby adjusts the luminous intensity of a lamp by controlling the switching of the transistor via said control circuit.

6. Apparatus as claimed in claim 5 wherein the second winding and the variable impedance element are arranged so that the variable impedance element is electrically isolated from said control circuit of the DC/AC converter.

7. Apparatus as claimed in claim 5 further comprising a transistor connected in series with the diode across the second winding and in parallel with the variable impedance element.

8. Apparatus as claimed in claim 5 wherein said connecting means connects the first winding, the switching transistor and a discharge lamp in a series circuit across the input terminals.

9. Apparatus as claimed in claim 5 wherein said variable impedance element comprises a manually adjustable variable resistor, and further comprising a capacitor connected in parallel with the variable resistor.

* * * * *

UNITED STATES PATENT AND TRADEMARK OFFICE

CERTIFICATE OF CORRECTION

PATENT NO. : 4,712,045

DATED : December 8, 1987

INVENTOR(S) : Johannes M. Van Meurs

It is certified that error appears in the above-identified patent and that said Letters Patent is hereby corrected as shown below:

IN THE CLAIMS

Claim 5, line 6 before "and" insert

--via rectifier means--

Signed and Sealed this

First Day of November, 1988

*Attest:*

*Attesting Officer*

DONALD J. QUIGG

*Commissioner of Patents and Trademarks*